United States Patent [19]

Schaub

[11] Patent Number: 4,854,045

[45] Date of Patent: Aug. 8, 1989

[54] MODULAR POCKETKNIFE

[75] Inventor: Michael Schaub, Basel, Switzerland

[73] Assignee: Wenger SA, Delémont, Switzerland

[21] Appl. No.: 908,705

[22] PCT Filed: Jan. 6, 1986

[86] PCT No.: PCT/CH86/00001

§ 371 Date: Aug. 25, 1986

§ 102(e) Date: Aug. 25, 1986

[87] PCT Pub. No.: WO86/04010

PCT Pub. Date: Jul. 17, 1986

[30] Foreign Application Priority Data

Jan. 1, 1985 [CH] Switzerland ..... 85/3

[51] Int. Cl.[4] ..... B26B 3/06; B26B 11/00

[52] U.S. Cl. ..... 30/155; 7/118; 455/344; 455/349

[58] Field of Search ..... 7/118, 170, 158; 30/125, 151–155; 455/344, 349

[56] References Cited

U.S. PATENT DOCUMENTS

| | | | |
|---|---|---|---|
| Re. 25,317 | 1/1963 | McCoy | 455/349 X |
| 766,059 | 7/1904 | Palmer | 30/153 |
| 1,200,079 | 10/1916 | Christensen et al. | 30/153 X |
| 3,714,249 | 8/1955 | Clark et al. | 30/153 |
| 4,000,475 | 12/1976 | Oiwa | 330/66 |
| 4,041,250 | 8/1977 | Sato | 455/344 X |
| 4,074,082 | 2/1978 | Sato et al. | 455/344 X |
| 4,119,813 | 10/1978 | Sato | 455/344 X |
| 4,187,607 | 2/1980 | Simuro et al. | 30/152 |
| 4,194,157 | 3/1980 | Uno | 455/349 X |
| 4,210,094 | 7/1980 | Kondo | 455/344 X |
| 4,233,686 | 11/1980 | Sato | 455/344 X |
| 4,356,631 | 11/1982 | Guth | 30/152 |
| 4,419,770 | 12/1983 | Yagi et al. | 455/349 X |
| 4,503,563 | 3/1985 | Johnson | 455/344 X |
| 4,578,628 | 3/1986 | Siwiak | 455/349 X |

FOREIGN PATENT DOCUMENTS

| | | |
|---|---|---|
| 1919970 | 11/1970 | Fed. Rep. of Germany . |
| 2424323 | 11/1975 | Fed. Rep. of Germany . |

*Primary Examiner*—Debra Meislin

*Attorney, Agent, or Firm*—Goodman & Teitelbaum

[57] ABSTRACT

The modular pocketknife system is assembled from a number of modules. Each of these modules consists at least of a tool element (12, 13) and of at least one connecting element (8, 11). The modules can be ranged side by side in any desired number and sequence, the connecting elements being provided with an electronic contact element (1) for data transmission, a locking element (2, 4, 5), and a sealing element, so that the modules are fashioned splash-proofly mechanically and electronically interconnectible and lockable and detachable from one another again.

6 Claims, 5 Drawing Sheets

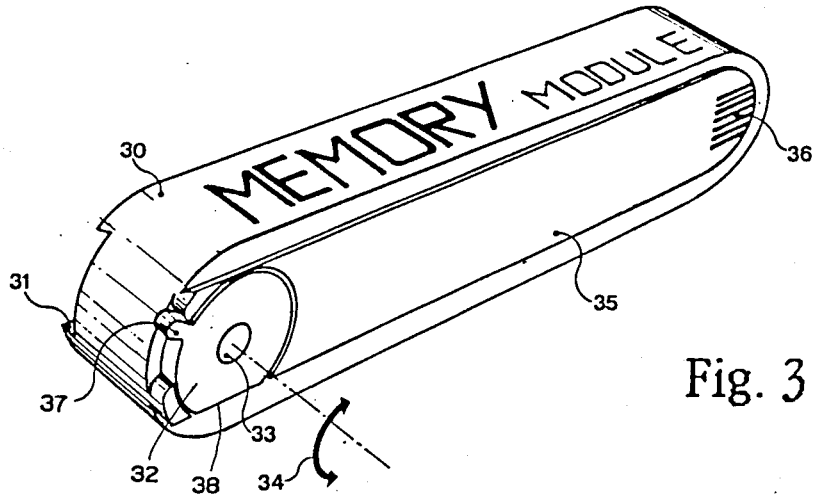
Fig. 3
Fig. 4
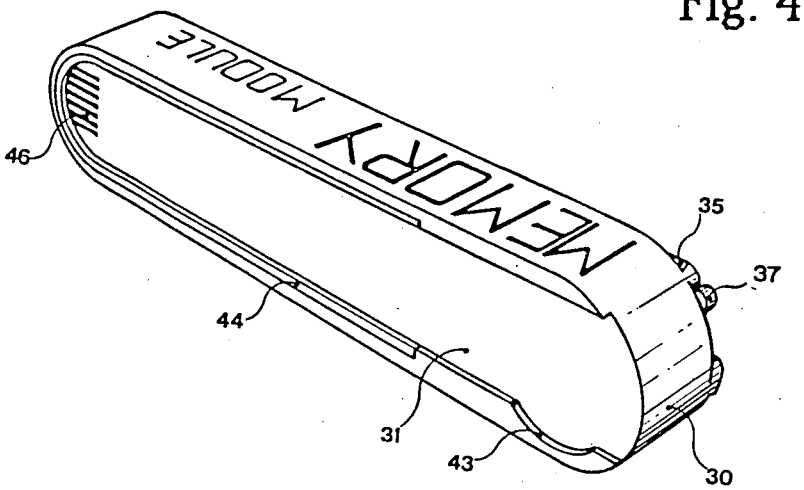

MODULAR POCKETKNIFE

The present invention relates to a modular pocketknife system.

The conventional pocketknife is a closed problem-solution system. It is not adaptable to a situation of use, and it is not expandible. That means that as the user of a conventional pocketknife, one must either carry around a large number of different tools in the form of a universally usable and correspondingly heavy pocketknife, or that one becomes the owner of a number of different pocket knives for different situations of use. Neither of these solutions can really give satisfaction.

It is a task of the present invention to provide a portable pocket-tool system which the user can put together from modularly combinable elements and take apart again according to his needs of the moment. This problem is solved by means of the characterizing features of the present invention.

The pocketknife according to the invention allows the owner a universal adaptation to the most varied situations without his having to carry an unwieldy object around with him for that reason. A further substantial advantage of the pocketknife system according to the invention as compared with conventional pocketknives consists in the augmentability at will of an already purchased basic system by means of additional expansion modules. For this reason, the pocketknife system can be unproblematically adapted to the technical advance and to the changing needs of the consumer. A further advantage consists in the reduced stockkeeping of the manufacturer and the dealer since with a relatively small number of modules, a large number of different module combinations can be offered. The modules can be ranged side by side in any desired number and sequence and detachably connected to one another by means of their connecting means.

Examples of embodiments of the invention, as well as of their use, are explained in detail below with the aid of the annexed drawing.

Figure 1:
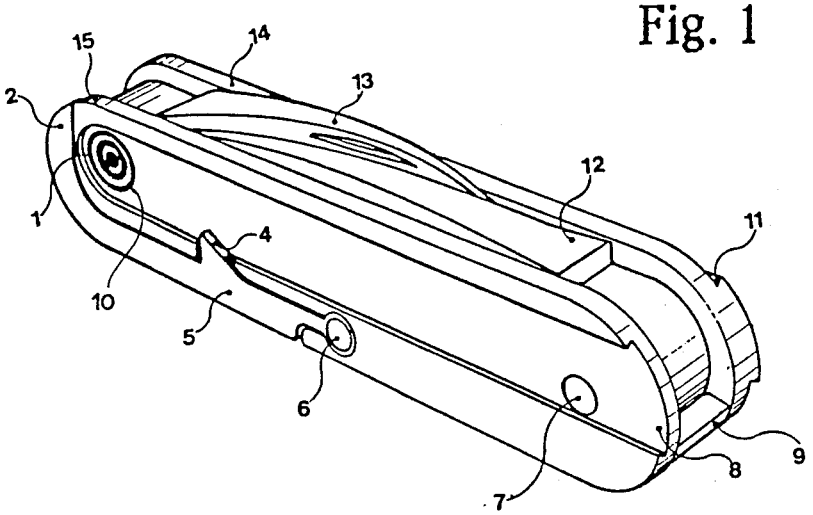
Figure 5:
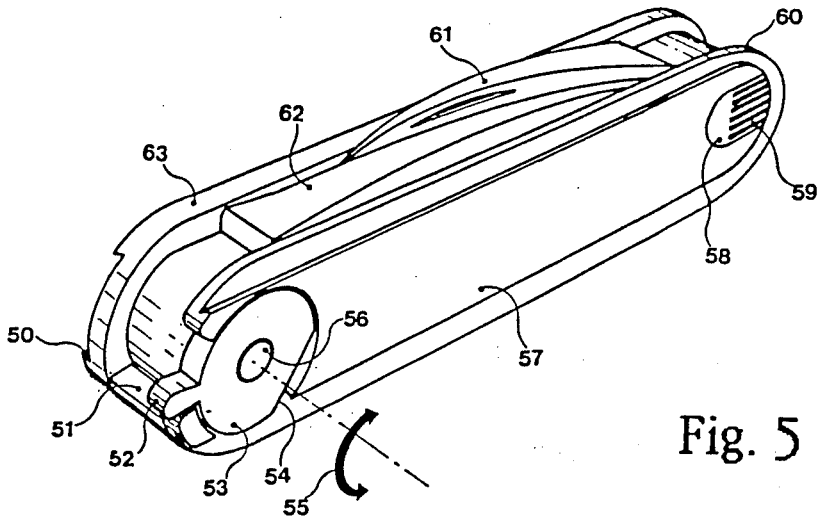
Figure 6:
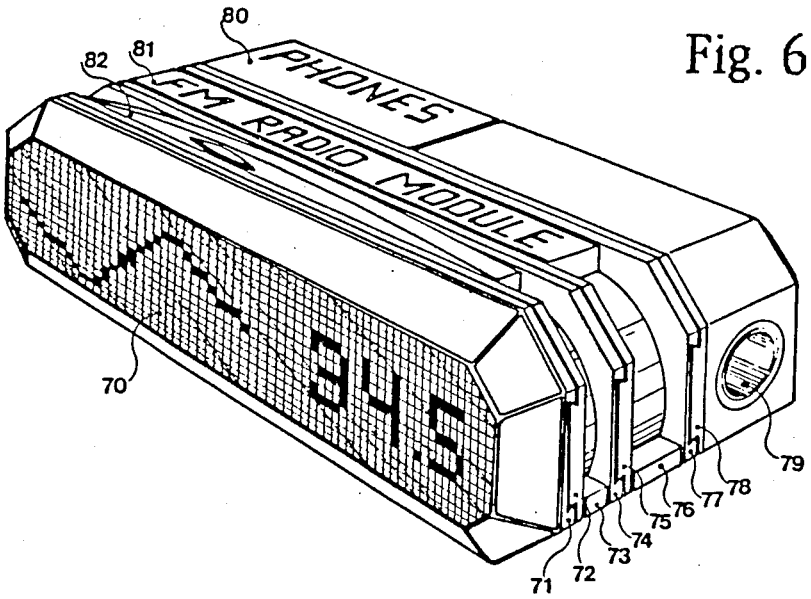
Figure 7:
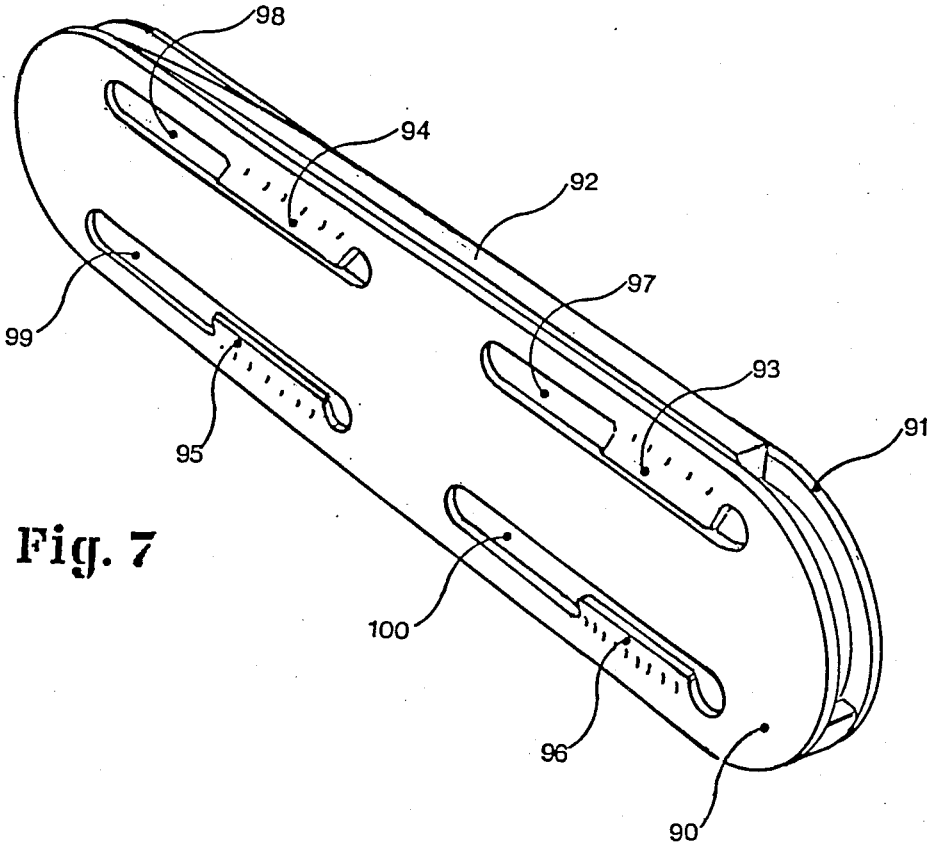
Figure 8:
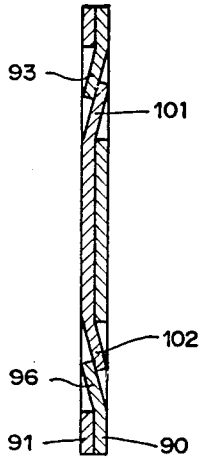

FIG. 1 shows a perspective representation of an embodiment of a single intermediate module of the pocketknife, the resilient safety element thereof being best shown in FIGS. 1*a*, 1*b* and 1*c*, FIG. 2 shows a perspective representation of a pocketknife system assembled from a number of modules according to FIG. 1, FIG. 3 shows a perspective representation of another embodiment of a single intermediate module as an electronic memory module, FIG. 4 shows a perspective representation of the back of the intermediate module corresponding to FIG. 3, FIG. 5 shows a perspective representation of an embodiment of an intermediate module as a support of two tool blades and for depicting a closed locking lever, FIG. 6 shows a perspective representation of a pocketknife system according to the invention, FIG. 7 shows a further embodiment of an intermediate module, and FIG. 8 shows a section perpendicular to the longitudinal axis of the embodiment according to FIG. 7.

Figure 1A:
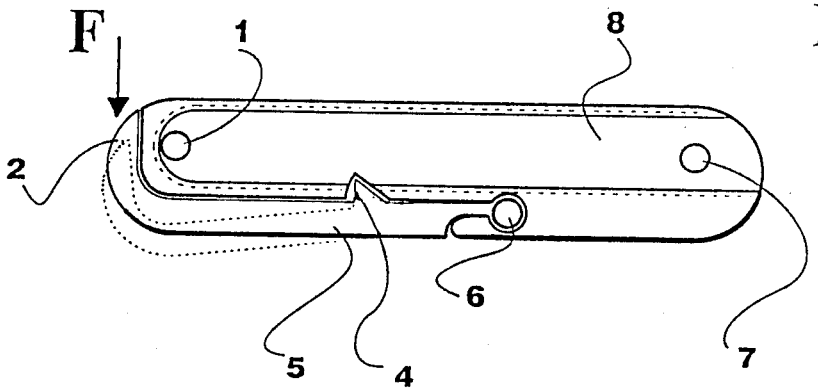
Figure 1B:
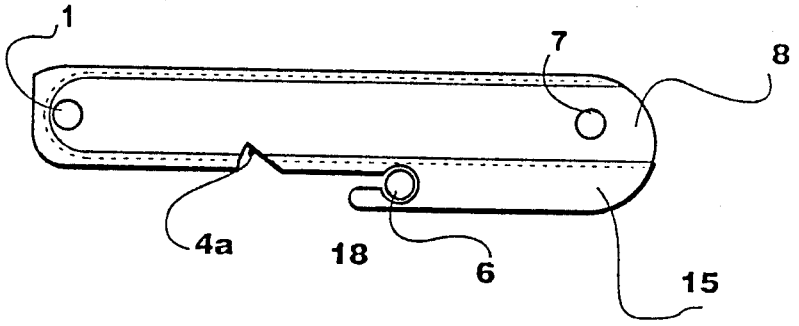
Figure 1C:
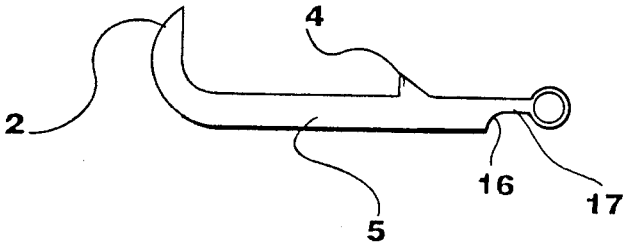

First, the basic construction shall be explained with the aid of an embodiment corresponding to FIG. 1. In this representation it is a question of an intermediate module or interchangeable section mounted with two tools 12, 13. The two tools 12, 13 are mounted in conventional manner on the spindles or arbors 7, 1 and, as in the known pocketknife design, are held fast in their positions by a steel spring 9 which is fixed on the spindle 6. The lateral side plates 14, 15 are likewise fixed by the spindles 7, 1, 6. The side plate 15 is provided with a dovetail undercut, groove-like recess 8 into which a connecting element, corresponding to a dovetail shaped connecting element 11, of an adjacent, additional intermediate module or interchangeable section not depicted in the drawing can be slidingly inserted. Such a sliding connection of two intermediate modules or interchangeable sections is secured by a resilient safety element 5, a safety point 4 thereof being disposed in a recess 4*a* and also fitting into a recess corresponding to the recess 4*a*, not visible in the drawing, in the connecting element 11 of a nondepicted intermediate module to secure the two intermediate modules together, and being releasable again only by an exertion of force F on a release lever 2 to disengage the safety point 4 from the respective recesses 4*a*. As shown in FIG. 1*b*, the recess 4*a* extends through the module to be formed in the connecting element on the opposite side thereof. Moreover, the safety element 5 is likewise held fast in its position by insertion of its tab 17, under cut at 16, into the slot formed by the tongue 18 and also by the spindle 6. In order to make possible on electrical connection between the individual modules, additional to the mechanical connection, for data exchange and for current supply, electrical contact rings 10 are provided for in the spindle 1 which are guided in the spindle 1 to the other side of the module where they can in turn be electrically connected to a non-depicted further module. Thus, the contact rings 10 of one module are in electrical contact with the contact rings of an adjacent module so that an electrical current can pass therebetween. Instead of the tool blade 13, an "electronic tool" such as, for example, a miniaturized radio receiver, a sensor unit, or an entry keyboard can also be inserted in the intermediate module, the integrated circuits of such an electronic tool having to be connected directly to the contact rings 10 of the spindle 1.

Figure 2:
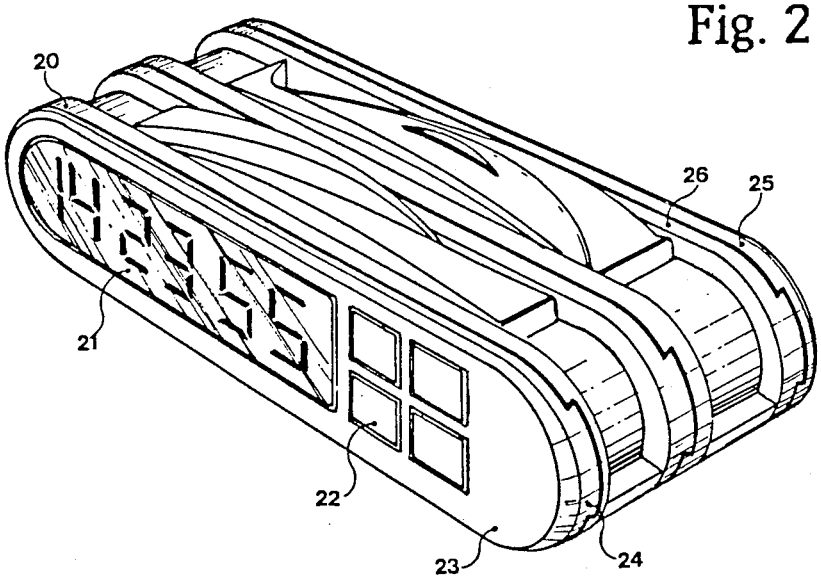

Depicted in FIG. 2 is a pocketknife system which is composed of two inner modules or interchangeable sections 20, 26 corresponding to FIG. 1 and of two outer end or cover modules or cover sections 23, 25, which combine together to form the handle of the pocketknife when the tool is extended outwardly, as per conventional pocketknives. In order to illustrate that the outer modules 23, 25 are especially well suited for input and output functions, a digital liquid crystal display 21 and a few entry keys 22 have been provided for in the depicted embodiment. Since the modules are also electronically interconnected, the display 21 and the entry keyboard 22 can be activated by several modules. Contrary to the inner modules 20, 26, each provided with two lateral expansion possibilities for adjacent modules, the outer cover modules 23, 25 are each provided with only one expansion possibility for further modules.

FIGS. 3 and 4 show two perspective representations of a further embodiment of an intermediate module 30 according to the invention. Here it is a question of an electronic memory module which cannot be swivelled out of the pocketknife system. Such a module can contain programs or data as a ROM memory or as a battery-buffered RAM memory. From FIG. 3 it is apparent how the locking mechanism is formed by a disk 32 rotatable about a spindle 33, provided with a lever 37, and flattened at a location 38. Contrary to its opened position in FIG. 3, the disk 32 is normally automatically rotated by a non-depicted return spring into a closed position corresponding to the closed position of the disk 53 from FIG. 5. Upon the insertion of the protruding insert connecting element 35 of the intermediate module 30 into the receiving connecting element or recess 31 of an adjoining module, the end opposite the disk 32 being inserted first, the disk 32 of the module 30 is automatically forced, by the flat end 38 engaging the side of the recess 31, into an opened position until the module 30 is completely inserted, whereupon the disk 32 of the module 30 can be rotated by its return spring until the cutout 43 of the adjoining module completely receives a round end portion of the disk 32 to lock the module 30 and the adjoining module together. Moreover, through a slightly eccentric position of the spindle 33 relative to the disk 32, the start of the closing operation is facilitated, and a constant pressure for a friction-type interlocking of the modules is achieved. In this embodiment the electronic contacts 36, 46 are disposed through the module in a parallel direction to the axis of insertion of one module into an adjacent module in order to avoid short circuits upon insertion. Accordingly the contacts 36,46 of one module are in electrical contact with the contacts 36,46 of an adjacent module when the modules are locked together. For the splash-resistant sealing of the module connection, a plastic element 44 is provided for, which, with the connection groove or recess 31 tapering slightly in breadth, ensures an increasingly wedging seal. The plastic element 44 is disposed in a U-shaped configuration on the walls of the groove 31 as shown in FIG. 4.

FIG. 5 shows an embodiment, related to the illustrations from FIGS. 3 and 4, of an intermediate module provided with two tool blades 61, 62. The spindles 56, 59 hold the blades 61, 62 and the lateral side plates 60, 63 together. The spindle 59, however, also may serve as a passage for the electronic bus lines 58 therethrough from one module side to the other, whereas the spindle 56 is also used for fixing the safety disk 53. Like the disk 32 from FIG. 3, the disk 53 is provided with two possible end positions of the rotary movement 55, the position of the flat 54 on the safety disk 53 deciding the locking (FIG. 5) or release of the connecting element 57 in a non-depicted adjoining additional intermediate module or cover module.

FIG. 6 shows a perspective representation of a pocketknife according to the invention. The receptacle module 80 contains an earphone which can be plugged into the jack 79. The modules are interconnected by means of the connecting elements 71, 72, 73, 74, 75, 76, 77, 78. The radio module 81 can be swivelled out like a conventional pocketknife tool for the battery change and for the station selection and for the volume control. The liquid crystal display 70 is constructed as a dot-matrix display, which allows the output of alphanumeric data as well as of graphs. In the embodiment according to FIG. 6, the display is used for representing the modulation and the channel selection.

The pocketknife can be expanded or increased in size by means of adding thereto a non-limited number of intermediate modules. To name just a few, a description of the possibilities follows here: all conventional pocketknife tools such as corkscrew, saw, knife, and file can be system-conformably constructed as modules. However, the possibility also exists of accommodating electronic modules such as a calculator module, watch module, or emergency-transmitter transmitter module in the system. Decoration elements allow a speedy adaptation to fashion colors and various target groups. However, receptacle elements may also be provided for, e.g., for receiving an earphone, a pillbox, or a removable writing implement.

In FIG. 7 a further embodiment of an intermediate module is depicted. The module comprises lateral side plates 90 and 91, as well as at least one tool element 92. Flaps 93, 94, 95, and 96 are punched out of the side plates and bent aside so that the flaps 93, 96 extend outwardly from the side plate 90 in directions towards each other, and the flaps 94, 95 also extend outwardly from the side plate 90 in directions towards each other. Furthermore, punched-out recesses 97, 98, 99, and 100 are provided for in the side plates. In this embodiment, it is a question of a solution which is economical and simple as to manufacturing technology. The flaps on the opposite side plate 91, which are not apparent from FIG. 7, are formed the same as in a further to-be-attached module, likewise not depicted, which can be joined together with the intermediate module apparent from FIG. 7. As indicated in FIG. 8, the flaps 101, 102 on the opposite side plate 91 are punched out and bent aside so that the flaps 101, 102 extend outwardly from the side plate 91 in directions away from each other. The flaps of two joinable modules are so formed that the flaps of the one side plate respectively fit into the recesses of the side plate of the other adjacent module, whereupon both modules can then be slid longitudinally together so that the flaps engage over one another with their inner surfaces engaging each other as shown in FIG. 8, and interconnect the modules. By means of an opposite lateral sliding, the modules can be separated from one another again.

In FIG. 8, a section perpendicular to the longitudinal axis of two intermediate modules is also depicted, whereby only the adjacent side plates 90 and 91 with the flaps 93 and 96, and 101 and 102, respectively, being depicted.

In the invention it is thus a question of a pocketknife system which is assembled from a number of intermediate modules and two cover modules. Moreover, each of the intermediate modules contains at least one tool element 12, 13 and of at least one connecting means 8, 11, the intermediate modules being arrangeable side by side in any desired number and sequence and detachably connectible to one another by means of their connecting means 8, 11. In a further embodiment of the system, the intermediate modules contain integrated circuits of electronics, all these modules and the tool elements also being electronically interconnected, in addition to the mechanical connecting means 31, 35, via electrical contact elements 36, 46. It is further proposed that each intermediate module 30 be provided on at least one side surface with a rail-like and undercut receiving connecting means 31 or an insertion connecting means 35 and that the connecting means of the intermediate modules be provided among themselves with a locking element 32, 43. Another embodiment provides for the locking elements 32 to act mechanically upon one another in such a way that they can be jointly released. In a further embodiment, the intermediate modules are constructed as an inner tool element having at least two connecting elements each or as a lateral end element having at least one connecting element each, the lateral end elements preferably being fashioned as supports of electronic input and output units. It is further proposed that the electronic data bus and the current-supply bus 59 be led through at least one of the spindles 58 of the tool elements 61, 62. Another embodiment provides for the connecting elements to be constructed as plugs and as depressions, the projecting connecting plugs of one modular element being pluggable into the depressions of the adjoining modular element, and this connection being ensured by means of a detachable and resilient locking element. A further embodiment provides for the connecting elements of modular elements to be formed by an adjustable clamp element.

I claim:

1. A pocketknife having a handle and at least one blade, wherein the improvement comprises;

first and second cover modules;

intermediate modules disposed between said first and second cover modules said intermediate modules including at least a first outer intermediate module and an opposite second outer intermediate module;

each of said intermediate modules including first and second side plates disposed on opposite sides of each of said intermediate modules, said first and second side plates of at least one of said intermediate modules being connected to each other and being spaced apart from each other by an arbor extending transversely through one end of said at least one intermediate module, said one blade being contained in said at least one intermediate module between said first and second plates thereof and being pivotable about said arbor;

said intermediate modules each having first connecting means for providing a detachable sliding connection thereof either to an adjacent one of said intermediate modules or to an associated adjacent one of said cover modules, said first and second cover modules each having second connecting means for providing a detachable sliding connection thereof to an associated adjacent one of said first and second outer intermediate modules;

said first and second connecting means slidingly connecting said first and second outer intermediate modules and said first and second cover modules together;

said first and second connecting means also permitting said first and second outer intermediate modules and said first and second cover modules to be slidingly separated apart from each other after having been connected together;

said first connecting means of said first and second outer intermediate modules being provided on said first and second side plates, respectively;

said first connecting means of said first side plate of said first outer intermediate module and said second connecting means of said first cover module being a longitudinally extending dovetail undercut, groove-like recess;

said first connecting means of said second side plate of said second outer intermediate module and said second connecting means of said second cover module being a protruding dovetail shaped connection element corresponding to each said recess so that each said protruding connection element is detachably slidingly received in an associated said recess for connection therebetween; and said intermediate modules and said first and second cover modules forming the handle of the pocketknife when the blade is pivoted outwardly from said at least one intermediate module.

2. A pocketknife according to claim 1, wherein one or more of said intermediate modules contains at least one tool element which is pivotable about an arbor of each said one or more intermediate modules extending transversely through one end of each said one or more intermediate modules.

3. A pocketknife according to claim 1, wherein said at least one intermediate module also contains a tool element disposed between said first and second plates thereof and being pivotable about a second arbor extending transversely through an opposite end of said at least one intermediate module.

4. A pocketknife according to claim 1, wherein one of said first and second side plates of said first and second outer intermediate modules includes locking means for releasably projecting into an associated recess in an associated adjacent one of said first and second cover modules to releasably lock said one of said side plates together with said adjacent one of said cover modules.

5. A pocketknife according to claim 2, wherein one of said intermediate modules contains an integrated electronic memory, and one of said cover modules contains a display and an entry keyboard.

6. A pocketknife according to claim 2, wherein one of said intermediate modules contains a radio receiver, and one of said cover modules comprises a compartment for an earphone and a corresponding socket for a plug of said earphone.

* * * * *